US006596376B1

(12) United States Patent
Bouic et al.

(10) Patent No.: US 6,596,376 B1
(45) Date of Patent: Jul. 22, 2003

(54) MASKING MATERIALS AND METHOD OF USE

(75) Inventors: Phillip J. Bouic, West Midlands (GB); Stephen C. P. Joseph, Warwickshire (GB)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/623,750

(22) PCT Filed: Mar. 9, 1999

(86) PCT No.: PCT/US99/05053

§ 371 (c)(1), (2), (4) Date: Sep. 8, 2000

(87) PCT Pub. No.: WO99/46056

PCT Pub. Date: Sep. 16, 1999

(51) Int. Cl.[7] ..... B05B 15/04

(52) U.S. Cl. ..... 428/158; 428/213; 428/304.4; 428/41.7; 427/282; 427/421; 156/94

(58) Field of Search ..... 156/247, 94, 280; 427/282, 421; 428/41.7, 43, 156, 158, 213, 220, 304.4

(56) References Cited

U.S. PATENT DOCUMENTS

| | | | |
|---|---|---|---|
| 1,960,137 | A | 5/1934 | Brown |
| 3,930,069 | A | 12/1975 | Stephens |
| 4,201,799 | A | 5/1980 | Stephens |
| 4,313,970 | A | 2/1982 | Jones et al. |
| 4,714,633 | A | 12/1987 | Horiki et al. |
| 4,759,959 | A | 7/1988 | Guy |
| 4,996,092 | A | 2/1991 | Francis et al. |
| 5,128,176 | A | 7/1992 | Schmidt |
| 5,260,097 | A | 11/1993 | Silvestre |
| 5,405,651 | A | 4/1995 | Western |
| 5,407,716 | A | 4/1995 | Mitchell |
| 5,413,637 | A | 5/1995 | Bastow |
| 5,468,533 | A | 11/1995 | Lipson |
| 5,567,239 | A | 10/1996 | Ribic, Jr. |
| 5,885,395 | A | 3/1999 | Western |

FOREIGN PATENT DOCUMENTS

| | | |
|---|---|---|
| DE | 2 254 811 | 10/1992 |
| DE | 2 288 137 | 10/1995 |
| DE | 296 17 703 | 10/1996 |
| DE | 297 05 114 | 3/1997 |
| EP | 0 257 872 A2 | 3/1988 |
| EP | 0 263 637 A2 | 4/1988 |
| EP | 0 384 626 B1 | 8/1990 |
| EP | 0 795 356 | 9/1997 |
| EP | 0 666 889 B1 | 9/1998 |
| GB | 885660 | 12/1961 |
| GB | 2 298 380 | 9/1996 |
| GB | 2 327 052 | 1/1999 |
| WO | WO 92/18252 | 10/1992 |
| WO | WO 94/10255 | 5/1994 |
| WO | WO 95/21700 | 8/1995 |
| WO | WO 95/24273 | 9/1995 |
| WO | WO 99/12654 | 3/1999 |

*Primary Examiner*—Sam Chuan Yao
(74) *Attorney, Agent, or Firm*—Scott R. Pribnow

(57) ABSTRACT

A masking material comprises an elongate strip at least partially coated with a layer of a pressure-sensitive adhesive, die strip having a curved surface which is convex when the strip is viewed in cross-section and is positioned such that when the strip is adhered to a substrate by the layer of pressure-sensitive adhesive a portion of the curved surface overhangs the substrate. The masking material comprises a removable edge portion comprising said portion of the curved surface detachably secured to a remainder of the strip and which may be removed to expose a second curved surface on the remainder of the strip which is convex when viewed in cross-section and which is positioned to overhang the substrate. The removable portion and remainder of the strip have different dimensions. Methods for making such masking material are also described.

3 Claims, 3 Drawing Sheets

MASKING MATERIALS AND METHOD OF USE

BACKGROUND OF THE INVENTION

1. Technical Field

This invention relates to masking materials and to their use during the application of two or more coating materials to a surface. In particular the invention relates to masking materials having a curved edge strip which is removable from the remainder of the masking material.

2. Description of the Related Art

Masking foam tape comprising a foam substrate having on part of its outer surface a layer of pressure-sensitive adhesive is known. A preferred tape has a cross-section comprising a curved surface e.g., circular or elliptical, since such masking tape allows a "feathered edge" or "soft edge", to be attained during surface coating operations, such as painting. The masking tape is positioned such that the curved surface overhangs the surface to be painted and thus when the paint is sprayed only paint projected at certain angles will pass beneath the overhanging portion of the masking tape and the paint thickness will be thinner, the edges beneath the overhang allowing a smooth transition to the adjacent painted area to be attained. The use of foam allows paint impinging thereon to be absorbed preventing it running off the masking material and marring the surface being treated. Such masking material is commercially available from 3M United Kingdom plc under the trade name Soft Edge Masking Foam Tape.

Soft edge masking foam tape (SEMFT) may be produced from a foam web by compression over a predetermined area with a blunt rotary cutter so that a cold-welded seam is formed which secures opposing surfaces of the web to each other at the region of the weld, thereby forming a curved surface. An array of circular or elliptical adjacent foam strips which are readily separable may be formed by passing a foam web through a plurality of parallel blunt rotary cutters causing compression and welding of the foam along parallel lines. The production of such foam strips is disclosed in EP-B-0384626. Other masking materials comprising foam, which may be cold-welded are disclosed in GB-2254811 and GB-2288137.

SEMFT is commonly used to mask the inside of door apertures to prevent paint or primer spray from contaminating the inside of the vehicle. After applying primer to a car panel it is desirable to apply the paint in a manner such that it extends beyond the primer to ensure the primer is completely covered and not left exposed. In such situations the SEMFT may be removed after application of the primer and repositioned. Alternatively, the SEMFT may be gently pushed in an attempt to displace it and position it away from the primer edge. Neither technique is satisfactory since it is labour intensive and not desirable if the primer is still wet.

The invention has been made with this point in mind.

SUMMARY OF THE INVENTION

According to one aspect of the invention there is provided a masking material comprising an elongate strip at least partially coated with a layer of a pressure-sensitive adhesive. The strip has a curved surface which is convex when the strip is viewed in cross-section and is positioned such that when the strip is adhered to a substrate by the layer of pressure-sensitive adhesive a portion of the curved surface overhangs the substrate. The masking material comprises a removable edge portion comprising the portion of the curved surface detachably secured to a remainder of the strip and which may be removed to expose a second curved surface on the remainder of the strip which is convex when viewed in cross-section and which is positioned to overhang the substrate. The removable portion and the remainder of the strip have different dimensions.

According to a second aspect of the invention there is provided a method of coating an area of the surface of a substrate with layers of a first and second coating material. The method comprises the steps of:

(i) Providing a masking material comprising an elongate or endless strip at least partially coated with a layer of a pressure-sensitive adhesive. The strip has a curved surface which is convex when the strip is viewed in cross-section and is positioned such that when the strip is adhered to a substrate by the layer of pressure-sensitive adhesive a portion of the curved surface overhangs the substrate. The masking material comprises a removable edge portion comprising the portion of the curved surface detachably secured to the remainder of the strip and which may be removed to expose a second curved surface on the remainder of the strip which is convex when viewed in cross-section and which is positioned to overhang the substrate. The removable portion and the remainder of the strip have different dimensions.

(ii) Applying the masking material to the substrate such that the curved surface is adjacent the edge of the area to be coated.

(iii) Applying the first coating material over the area of the surface up to the masking material.

(iv) Detaching and removing the removable portion of the masking material.

(v) Applying the second coating material over the first coating material and up to the remainder of the masking material.

The masking material of the invention is simple and effective to use. The elongate strip is applied to the surface in the normal manner with the curved surface adjacent the edge of the area of the surface to be coated. After application of a first coating material, e.g., primer, the curved surface is readily removable to expose a second curved surface slightly extending the area to be coated such that the second coating will completely overlap the first coating while ensuring a feathered edge is obtained. Thus, repositioning of the masking material between successive coating operations is unnecessary.

The masking material is preferably made of foam and may conveniently be produced by cold-welding foam web by the techniques disclosed in EP-0384626. Polyurethane foam is preferred for use in the cold-welded embodiments of the invention. The foam preferably has a density of about 26 $Kg/m^3$. A preferred cold-weldable foam is commercially available from Caligen Foam Limited under the trade designation "Grade 4273A".

The removable edge of the masking material may be achieved in various ways.

In one embodiment, the elongate strip may be formed with a circular or elliptical cross-section and a layer of foam or similar material releasably secured to and following the contour of the curved surface extends as a strip along the length of the masking material to form a removable edge. The removable strip may be secured by pressure-sensitive adhesive, welding or a combination thereof.

Such a masking material may be made by a method which comprises the steps of:

(a) providing a first cold-weldable foam web;

(b) applying at least two parallel stripes of a pressure-sensitive adhesive to a surface of the foam web;

(c) applying a second cold-weldable foam web having a thickness less than that of the first web to the first web such that the second web overlaps but does not completely cover the adjacent parallel stripes of pressure-sensitive adhesive;

(d) compressing the first and second cold-weldable webs midway between the adjacent stripes of pressure-sensitive adhesive using a blunt rotary cutter so that a cold-welded seam is formed which secures the two webs to each other at the region of the weld thereby forming a curved surface; and (e) compressing the first web using a blunt rotary cutter so that a cold-weld is formed which secures opposing surfaces of the web to each other in the region of the weld thereby forming a curved surface, said web(s) being compressed along at least three parallel lines to form at least two cords of circular or oval cross-section.

The elongate strip may comprise a plurality of removable edge portions in the form of layers of foam following the contour of the curved surface and extending along the length of the strip. Such masking materials may be made by a method comprising the steps of:

(a) providing a first cold-weldable foam web;

(b) providing at least two second cold-weldable foam webs having a thickness and width smaller than that of the first cold-weldable foam web;

(c) adhering said second webs to a surface of the first web with pressure-sensitive adhesive to form parallel strips of said second webs;

(d) compressing said first and second cold-weldable webs using a blunt rotary cutter so that a cold-welded seam is formed which secures the first and second webs together at the region of the weld thereby forming a curved surface, said webs being compressed along at least two parallel lines along the longitudinal axis of the second webs to form at least one cord of circular or oval cross-section; and (e) applying a pressure-sensitive adhesive to the surface of the first web in the region between the second webs prior to cold-welding or to the surface of the first web of the cord between the second webs after cold-welding.

In a further embodiment the masking material may comprise a primary cord of circular or elliptical cross-section having a strip of pressure-sensitive adhesive coated thereon and a secondary cord parallel to the primary cord releasably secured thereto. The secondary cord may readily be formed simultaneously with the primary cord from a foam web by cold-welding.

Such a masking material may be made by a method comprising the steps of:

(a) providing a cold-weldable foam web;

(b) compressing said foam web using at least one blunt rotary cutter so that a cold-welded seam is formed which secures opposing surfaces of the web to each other at the region of the weld, thereby forming a curved surface, said web being compressed along at least three parallel lines to form at least two cords having a pair of longitudinal weld seams and a circular or oval cross section, two cords being releasably secured by a common weld and having different dimensions; and (c) applying a stripe of pressure-sensitive adhesive to the web in the region of the cord having the larger dimension prior to cold-welding or to the cord of larger dimension after cold-welding.

In a further embodiment of the invention the masking material may be in the form of an endless elongate strip e.g., a closed curve, such as a circle or ellipse or other shape, e.g., square, hexagon etc. A concentric array of such strips may be formed e.g., by compressing and cold-welding foam, adjacent strips being separable from each other by tearing the weld. Examples of such an array are disclosed in GB-2254811. In use, the user removes sufficient strips which define an aperture having the area of the surface to be coated and the masking material is applied to the surface. After the first coating e.g., primer has been applied, the inner strip is removed and the second coating applied overlapping the first coating.

BRIEF DESCRIPTION OF THE DRAWINGS

The invention will now be described with reference to the accompanying drawings in which.

DETAILED DESCRIPTION OF THE PREFERRED EMBODIMENTS

Figure 1A:
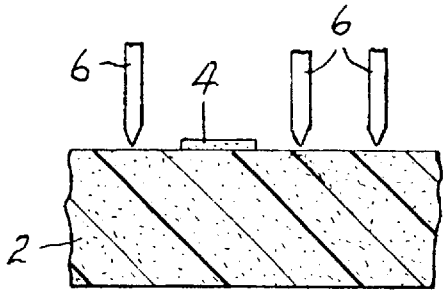
FIGS. 1*a* and *b* illustrate the production of a masking material in accordance with one embodiment of the invention.

FIGS. 1*a* and *b* illustrate the production of a masking material in accordance with one embodiment of the invention. FIG. 1*a* shows, in cross-section, a portion of a foam web (2) on which is coated a stripe of pressure-sensitive adhesive (4). The foam web is passed through a multi-slitter fitted with crush cutter blades (6). Three crush cutter blades (6) are shown which are spaced an appropriate distance apart to form a primary cord (8) and a secondary cord (10). A repeating arrangement of such cutter blades may extend across the full width of the web to produce a multiple array of masking strips.

Figure 1B:
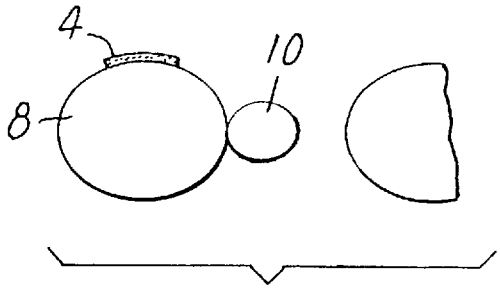

The crush cutter blades compress the foam web and form a cold-weld which holds the foam in the curved configuration shown in FIG. 1*b*. A primary cord (8) having the stripe of pressure-sensitive adhesive (4) is formed joined to a secondary cord (10) by a common cold-weld. The secondary cord (10) is readily separable from the primary cord (8) by tearing along the weld.

Figure 2A:
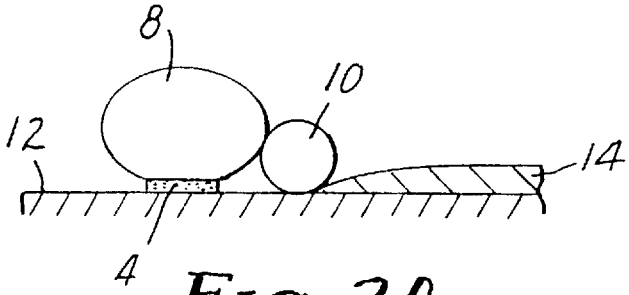
FIGS. 2*a* and *b* illustrate the use of the masking material of FIG. 1.
Figure 2B:
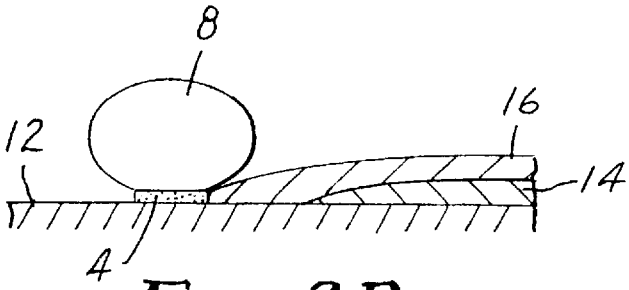

FIGS. 2*a* and *b* illustrate the use of the masking material. The masking material is secured to a surface (12) to be coated by the pressure-sensitive adhesive stripe (4). The masking material is positioned such that the secondary cord (10) contacts the surface (12) and is adjacent the area to be coated. A first coating (14) (shown in exaggerated thickness) is applied. Typically the first coating (14) will be a primer. It will be noted that the coating (14) extends under the curvature of the secondary cord (10) resulting in a tapered or feathered edge to the coating (14).

The secondary cord (10) is removed by tearing along the cold-weld. The primary cord (8) remains in position and a second coating (16) (shown in exaggerated thickness) is applied over the first coating (14). The second coating (16) extends over the edge of the coating (14) and under the overhanging curvature of the primary cord (8) thereby assuring that none of the coating (14) is exposed and providing a feathered edge to the coating (16). Thereafter, the primary cord (8) is removed.

The dimensions of the primary and secondary cords may be varied by suitable selection of the thickness of the foam web and spacing of the crushed cutter blades. Suitable masking materials have been produced from a foam web having a thickness of about 15 mm to produce a substantially cylindrical primary cord having a diameter of approximately 13 mm. Secondary cords of approximately 3, 6 and 7 mm attached to the primary cord have been formed by suitable spacing of the crushed cutter blades.

Figure 3A:
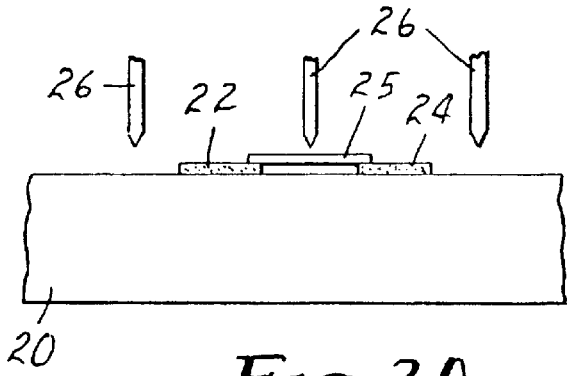
FIGS. 3*a* and *b* illustrate the production of a masking material in accordance with a second embodiment of the invention.

FIGS. 3*a* and *b* illustrate the production of a masking material in accordance with a second embodiment of the invention. A foam web (20) is coated with two stripes of pressure-sensitive adhesive (22, 24) and a second thinner foam web (25) e.g., having a thickness of 2 to 5 mm, is placed such that it overlaps, but does not completely cover, the adhesive strips (22, 24). The composite web is fed into a multi-slitter fitted with crushed cutter blades the positions of which are shown at 26. The crush cutter blades compress the foam web forming cold-welds resulting in the production of two separate masking strips (28). Each masking strip (28) comprises a substantially cylindrical portion (30) formed from the foam web (20), an adhesive stripe (22, 24) and a removable edge portion (32) formed from the foam web (25) which is secured to the cylindrical portion (30) by the adhesive stripe (22, 24) and a cold-weld. The removable edge (32) follows the cylindrical contour of the core (30).

Figure 4A:
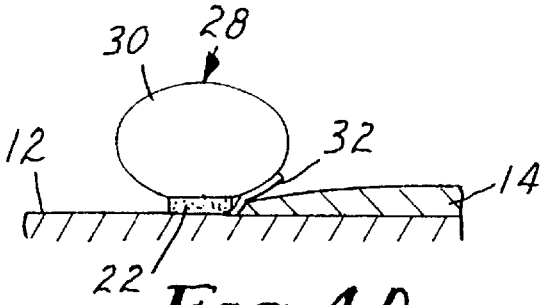
FIGS. 4*a* and *b* illustrate the use of the masking material of FIG. 3.

FIGS. 4*a* and *b* illustrate use of the masking material (28). The masking material is positioned on a surface (12) to be coated and secured by the pressure-sensitive adhesive stripe (22, or 24, not shown). The masking material is positioned such that the removable edge (32) is adjacent the edge of the area to be coated. A first coating material (14), e.g., primer, is applied, some of which extends beneath the overhang of the curve of the removable edge (32) to provide a feathered edge to the coating. Thereafter, the removable edge (32) is stripped from the core (30) without displacement of the core thereby exposing the curved surface of the core adjacent the edge of the area to be coated. A second coating (16) is applied over the first coating. The second coating (16) completely overlays the first coating and extends under the overhang of the curve of the core (30) thereby providing a feathered edge to the second coating. Thereafter, the masking material is removed.

Figure 3B:
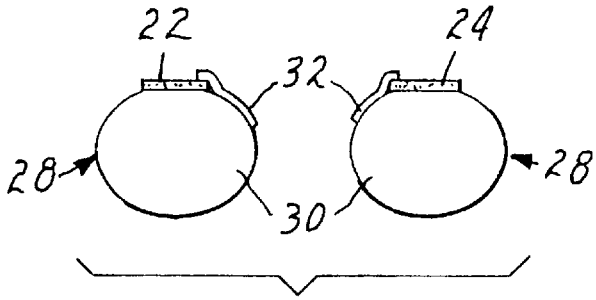
Figure 4B:
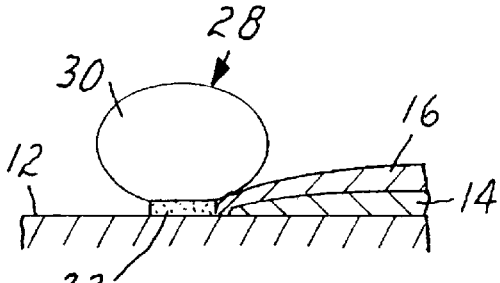
Figure 5A:
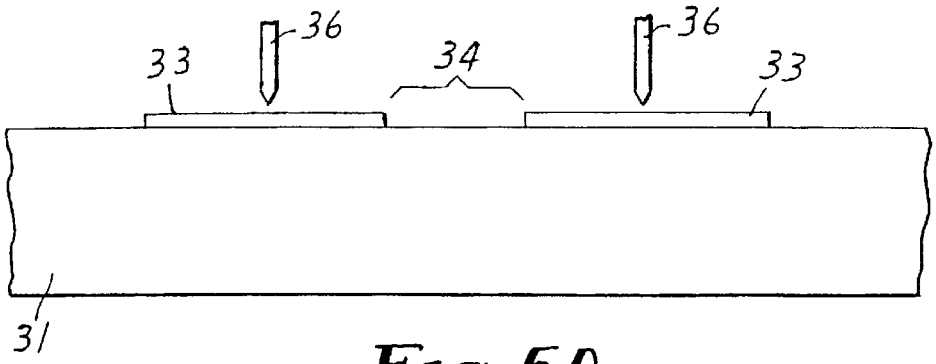
FIGS. 5*a* and *b* illustrate the production of a further masking material in accordance with the invention.
Figure 5B:
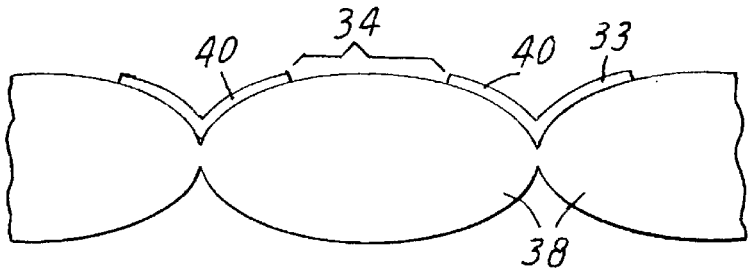

FIGS. 5*a* and *b* illustrate the production of a masking material similar to that disclosed in FIGS. 3 and 4 but having two removable edges. The masking material is formed from a foam web (31) on which two thin foam strips (33) are adhered by a pressure-sensitive adhesive or double sided pressure sensitive adhesive tape (not shown). The two foam strips (33) are separated by a gap (34) on which a stripe of pressure-sensitive adhesive is applied either before or after cold-welding. The composite web is fed into a multi-slitter fitted with crusher blades (36) which compress the foam and form a cold-weld. The resultant masking material is shown in FIG. 5*b* and comprises an array of masking material each comprising a central core (38) and a pair of removable edges (40). Adjacent masking strips are adhered to each other by the cold-weld but are readily separable. Each masking strip may be used in the manner described with reference to FIGS. 4*a* and *b*.

Figure 6:
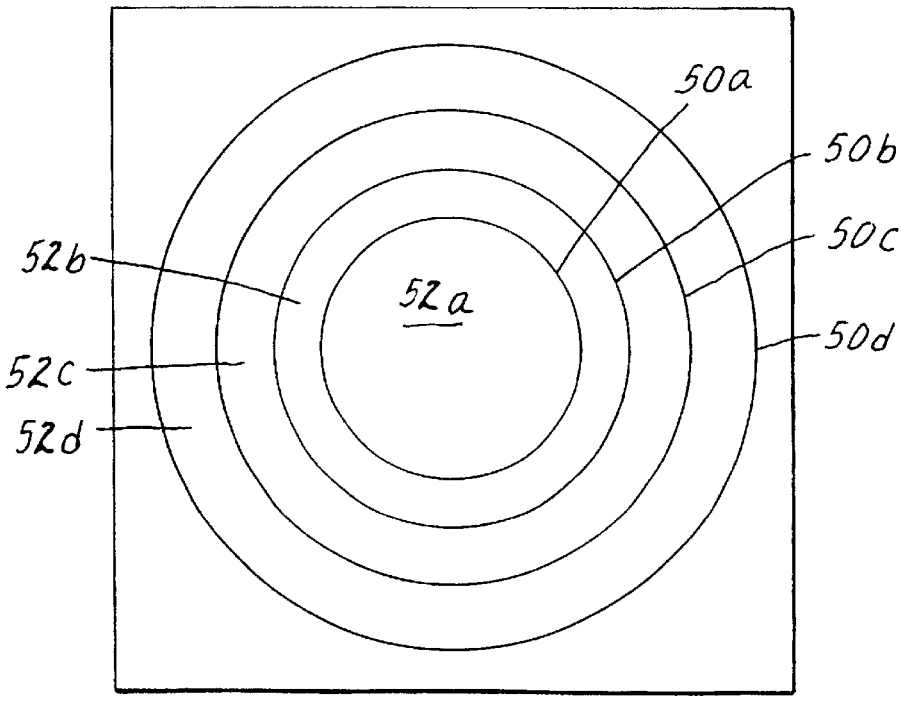
FIG. 6 illustrates masking material for use in the invention.

FIG. 6 of the accompanying drawings illustrates a variable size painting mask which is made by die stamping a foam web e.g., 5 mm thick, in a manner such that the die steel does not cut all the way through the foam but the foam is marked with a series of concentric cold-welds. The overall masking material may be in the region of 1 meter square and comprise a plurality of concentric welds (50*a* to 50*d*) defining annular segments (52*a* to 52*d*). In use, one or more segments of the mask large enough to completely reveal the area to be painted is removed e.g., segment (52*a*), and the mask applied to the surface and held in place by a layer of adhesive (not shown). A first coating material is applied, the mask allowing formation of a feathered edge due to the curvature caused by the cold-weld. The inner segment of the mask e.g., segment (52*b*) is then removed by tearing the cold-weld thereby exposing a further curved surface. A second coating material is applied over the first coat, the curve of the remaining masking material causing a feathering effect at the edge of the top layer. It will be appreciated that a variety of shapes other than circular may be employed for the variable size painting mask.

What is claimed is:

1. A masking material comprising an elongate strip at least partially coated with a layer of pressure-sensitive adhesive, the strip having a curved surface which is convex when the strip is viewed in cross-section and is positioned such that when the strip is adhered to a substrate by the layer of pressure sensitive adhesive a portion of the curved surface overhangs the substrate, wherein the masking material comprises a removable edge portion comprising said portion of the curved surface detachably secured to a remainder of the strip which may be removed to expose a second curved surface on the remainder of the strip which is convex when viewed in cross-section and which is positioned to overhang the substrate, said removable portion and the remainder of the strip having different dimensions, wherein the elongate strip is formed of a cold-weldable foam and has at least one cold-welded scam along its longitudinal length which maintains the configuration of the curved surface; and wherein the removable edge portion comprises a foam cord of substantially circular cross-section detachably secured to the elongate strip by a cold-weld.

2. A masking material as claimed in claim 1 in which the elongate strip comprises a pair of cold-welded seams and has a substantially oval or circular cross-section.

3. An array comprising a plurality of adjacent strips of masking material as claimed in claim 1 in which adjacent strips are releasably joined to each other by longitudinal welded seams.

* * * * *

UNITED STATES PATENT AND TRADEMARK OFFICE

CERTIFICATE OF CORRECTION

PATENT NO. : 6,596,376 B1
DATED : July 22, 2003
INVENTOR(S) : Bouic, Phillip J.

It is certified that error appears in the above-identified patent and that said Letters Patent is hereby corrected as shown below:

Title page,
Item [57], ABSTRACT,
Line 3, delete “die” and insert in place thereof -- the --.

Column 5,
Lines 12, 18 and 26, delete “crushed” and insert in place thereof -- crush --.

Column 6,
Line 2,delete “crusher” and insert in place thereof -- crush --.
Line 48, delete “scam” and insert in place thereof -- seam --.

Signed and Sealed this

Thirteenth Day of April, 2004

JON W. DUDAS
*Acting Director of the United States Patent and Trademark Office*